US005558583A

United States Patent [19]

Shimomura

[11] Patent Number: 5,558,583

[45] Date of Patent: Sep. 24, 1996

[54] COIN TRANSFER APPARATUS FOR JUGGLERY USE

[75] Inventor: Tomoyuki Shimomura, Higashikurume, Japan

[73] Assignee: Tenyo Co., Ltd., Japan

[21] Appl. No.: 416,987

[22] Filed: Apr. 5, 1995

[30] Foreign Application Priority Data

Jun. 1, 1994 [JP] Japan ..... 6-120138

[51] Int. Cl.[6] ..... A63J 21/00

[52] U.S. Cl. ..... 472/71; 472/63

[58] Field of Search ..... 472/71, 72, 63, 472/51, 69; 446/10, 13

[56] References Cited

U.S. PATENT DOCUMENTS 2,323,221 6/1943 Hockey et al. ..... 446/13 X
3,822,879 7/1974 Guitar ..... 472/72

FOREIGN PATENT DOCUMENTS 1074811 1/1992 Russian Federation ..... 472/71

*Primary Examiner*—Kien T. Nguyen
*Attorney, Agent, or Firm*—Sixbey, Friedman, Leedom & Ferguson, P.C.; Gerald J. Ferguson, Jr.; David S. Safran

[57] ABSTRACT

The base member is provided with a coin slot and opening. Plate members to close and open the coin slot and opening are disposed movably in relation to the base member. The plate members are so supported by support members as to be movable between closed and opened positions.

When the coin transfer apparatus is used, it is placed on the top of a table with the plate members closed. A coin is set in the coin slot. A handkerchief or the like is put over the apparatus. When the apparatus is lifted off the table top along with the handkerchief, the plate members are opened due their own weight and the coin falls onto the top of the opened plate member through the coin slot. The apparatus covered with the handkerchief are placed onto the table top again, the plate members are closed, and then the handkerchief is taken away from on the apparatus. The audience will be given an illusion that the coin has been transferred from the coin slot to the top of the plate member. Thus, the apparatus can be simply used for the fun of coin transfer jugglery.

8 Claims, 11 Drawing Sheets

COIN TRANSFER APPARATUS FOR JUGGLERY USE

The present invention relates to a coin transfer apparatus for jugglery use to relocate a disc-like thing such as coin, medal or the like (will be genetically referred to as "coin" hereinafter).

SUMMARY OF THE INVENTION

The present invention has an object to provide an easy-to-operate coin transfer apparatus for jugglery use.

The coin transfer apparatus according to the present invention comprises a base member having a coin-insertion block (slotted) and an opening formed therein, plate members movably fitted to the base member to close the coin slot and openings, and support members to support the plate members movably between the closed and opened positions. When placed in the closed position, the plate members close the coin slot and openings to block a coin set in the coin slot from falling. The plate members are generally flush at the top thereof with that of the base member so that the base and plate members appear like a single plate. When in the opened position, the plate members fall due to their own weight and the coin having been held in the coin slot dosed with the plate members will fall down through the slot onto the top of the plate member.

The coin transfer apparatus according to the present invention may also be provided with a locking mechanism to lock the plate members in the closed position and free them from the locked status.

The apparatus according to the present invention is to be used as will be described herebelow:

First, the user places the apparatus on the top of a table or on the palm with the plate members closed. In this condition, the opening in the base member is closed with the plate members and the top of the base member is generally flush with those of the plate members so that they appear like a single plate. The user sets a coin in the coin slot. Since the coin slot is still closed with the plate member, the coin is held there from falling.

Here the user takes a handkerchief or the like and places it over the apparatus. Then the user takes the handkerchief-covered apparatus from on the table top or the palm. The plate members will be opened due to their own weight. The coin will fall down through the coin slot onto the opened plate member.

The user returns the handkerchief-covered apparatus onto the table top or the palm, and then closes the plate members. At this time, the coin is positioned on the top of the closed plate member. Then, the user takes off the handkerchief from on the apparatus. As mentioned above, the base and plate members appear like a single plate. Actually, however, the coin has simply fallen onto the top of the opened plate member through the coin slot. The audience will be given an illusion that the coin has been transferred from the coin slot to the top of the base member (actually onto the plate member).

As mentioned above, the apparatus according to the present invention can be very easily operated for the fun of coin transfer jugglery.

In the coin transfer apparatus provided with a locking mechanism according to the present invention, the plate members can be locked in the closed position by the locking mechanism and thus the apparatus can be lifted off the table top or palm with the plate members kept closed. When the locking mechanism is pressed to free the plate members with the apparatus held as lifted off the table top or palm, the plate members are opened due to their own weight. Thus, the above-mentioned operation can be done positively.

How the above-mentioned and other objects of the present invention are achieved will be evident in the more detailed description of a preferred embodiment of the invention which will now be set forth in reference to the drawings.

It should be noted that the second plate member and others are shown as not cut by any sectional plane in FIGS. 7 to 10, 15 and 17.

DETAILED DESCRIPTION OF THE PREFERRED EMBODIMENT

Figure 1:
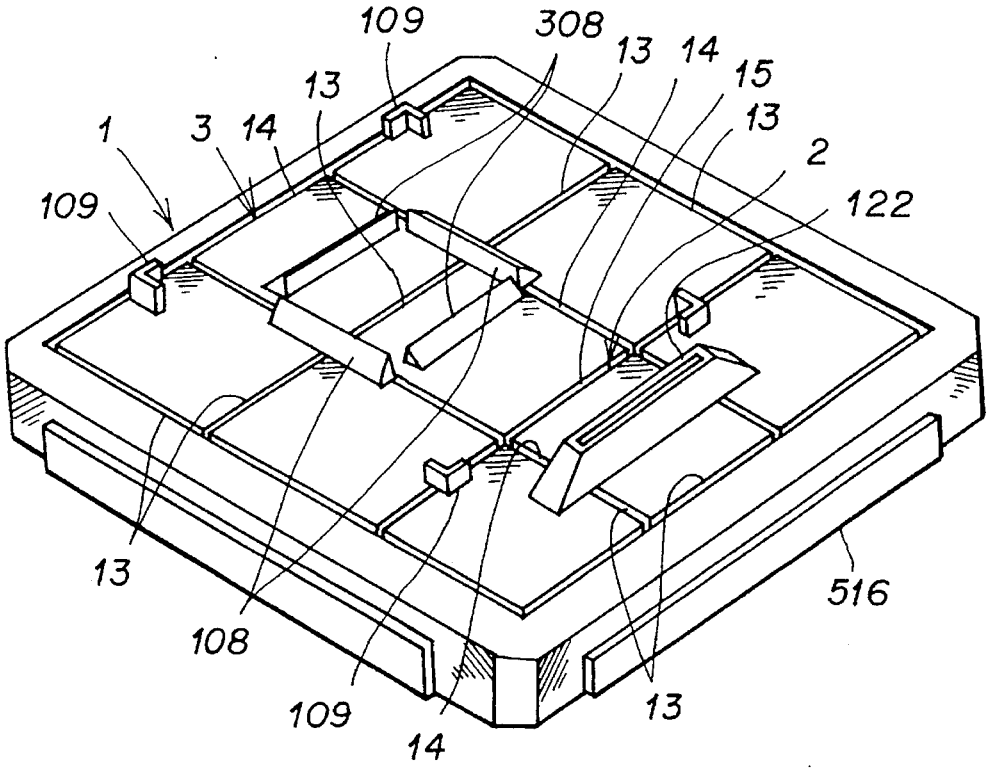
FIG. 1 is a perspective view of a preferred embodiment of the coin transfer apparatus for jugglery use according to the present invention, showing the plate member in the closed position.
Figure 2:
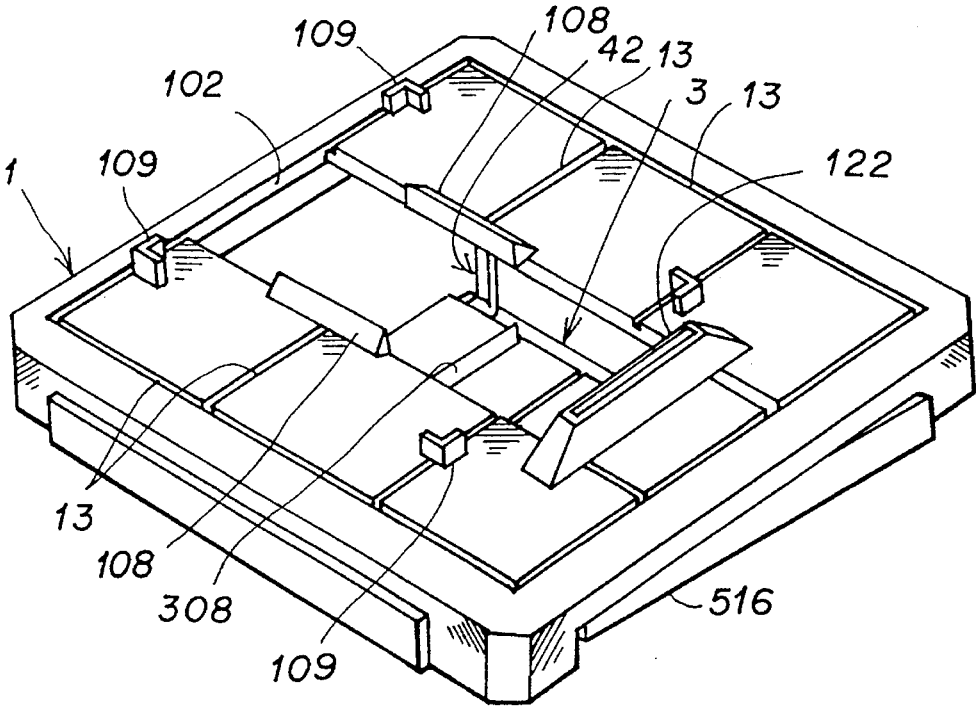
FIG. 2 is a perspective view of the apparatus with the plate members in the closed position.

In FIGS. 1 and 2, the coin transfer apparatus for jugglery use according to the present invention comprises a base member 1 which is a thin hollow case having such dimensions that it can be held in hand and of which the shape is generally square when viewed from above. Further, the base member 1 consists of an upper portion 10 made of, for example, an opaque synthetic resin a lower portion 11 made also of, for example, an opaque synthetic resin and a coin-insertion block 12 made of, for example, a transparent synthetic resin as shown in FIG. 3.

Figure 3:
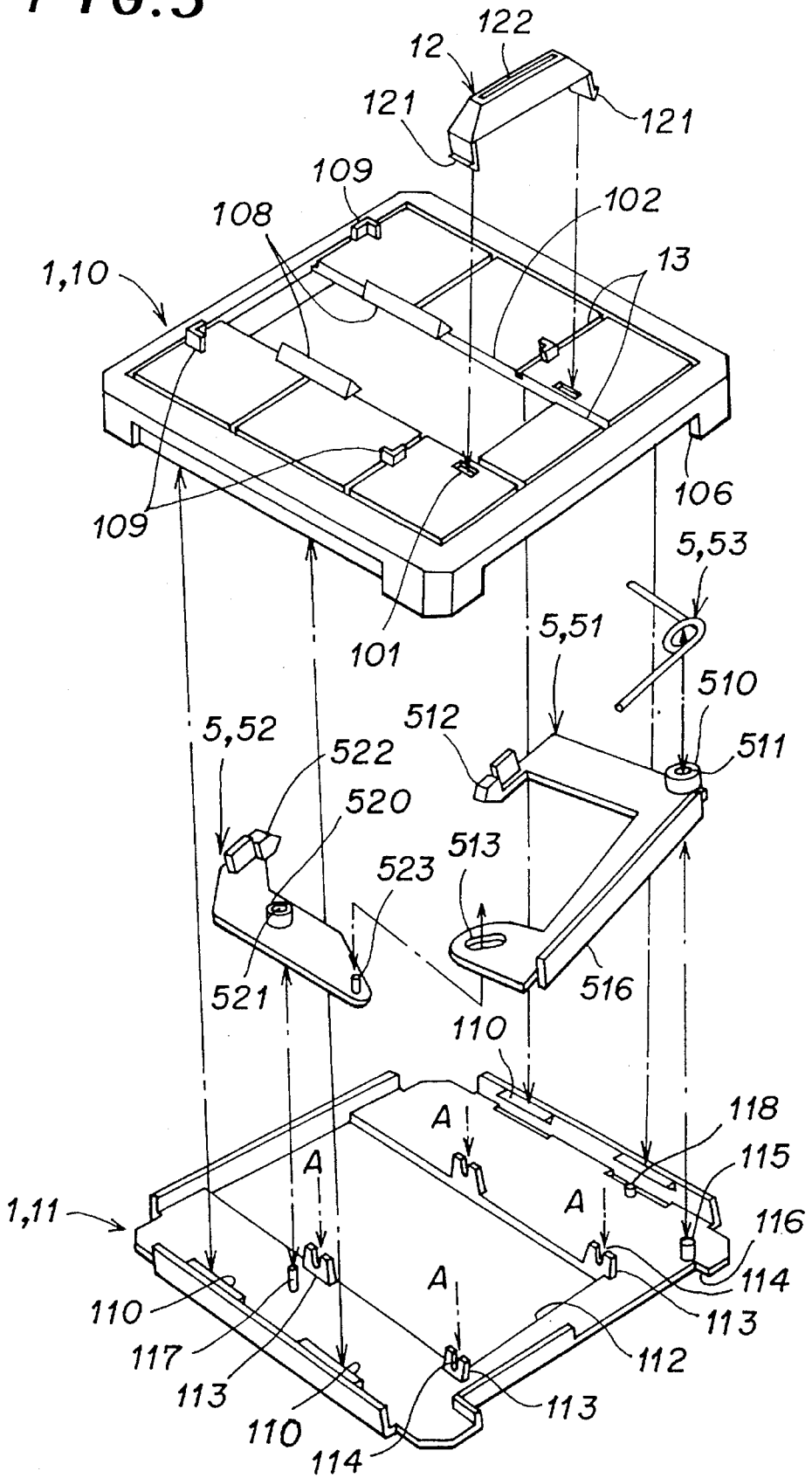
FIG. 3 is an exploded perspective view of the base member and locking mechanism.
Figure 7:
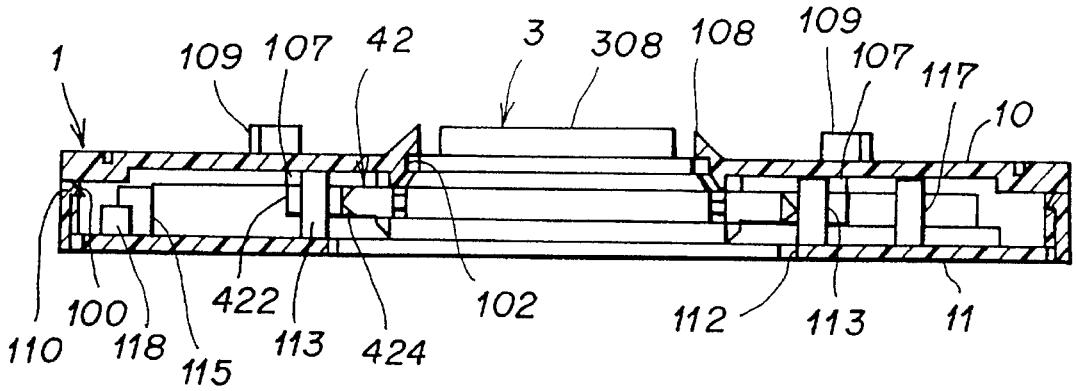
FIG. 7 is a sectional view taken along the line VII—VII in FIG. 1.
Figure 8:
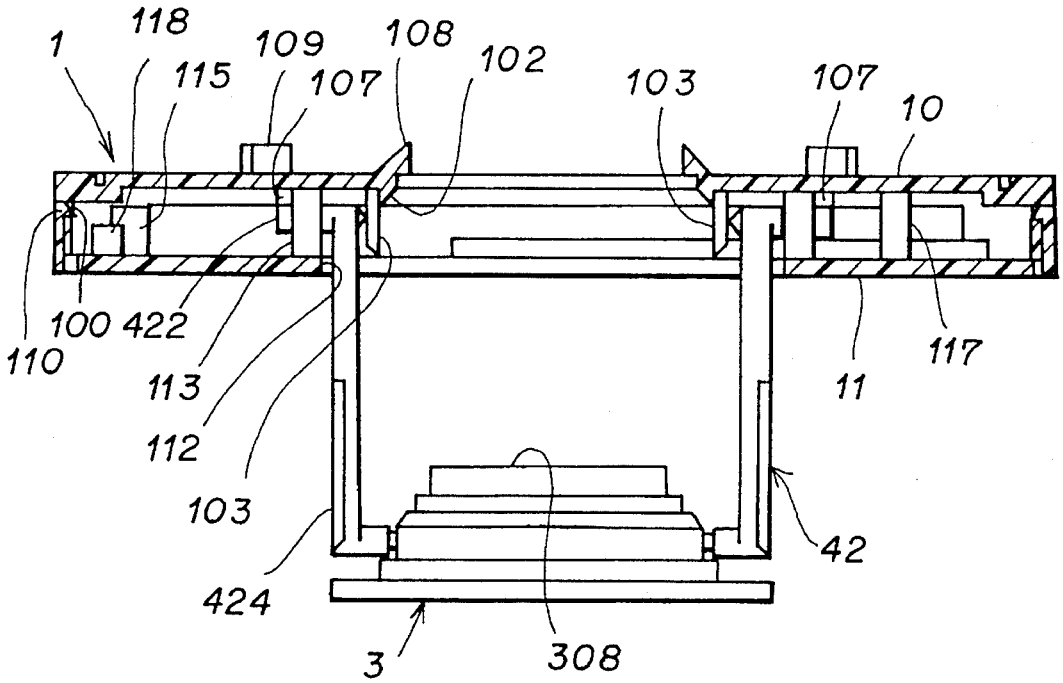
FIG. 8 is a sectional view taken along the line VIII—VIII in FIG. 2.

As shown in FIGS. 3, 7 and 8, the upper portion 10 has recesses 100 formed in the opposite side walls, respectively, thereof and the lower portion 11 has pawls 110 formed on the opposite side walls, respectively, thereof in positions corresponding to those of the recesses 100. By engaging the pawls 110 of the lower portion 11 into the corresponding recesses 100, respectively, of the upper portion 10, the upper and lower portions 10 and 11 are assembled together to form the above-mentioned thin hollow case. As shown in FIG. 3, the upper portion 10 has holes 120 formed therein and the coin-insertion block 12 has pawls 121 formed on the opposite ends thereof. By inserting the pawls 121 into the holes 120, respectively, the coin-insertion block 12 is fixed to the upper portion 10.

As also seen from FIG. 3, the upper and lower portions 10 and 11 forming together the base member i have rectangular openings 102 and 112 formed, respectively, therein. The coin-insertion block 12 has formed therein a slot 122 through which a coin is to be inserted into the case or base member 1.

As shown in FIGS. I and 2, the base member i supports plate members 2 and 3 by means of support members 41 and 42 in such a manner that the plate members 2 and 3 can be moved between a closed position (where they are fitted to the base member 1) and an opened position (where they are separated from the base member 1), which will be further described herebelow.

When in the closed position (shown in FIGS. 1, 7, 9 and 11), the plate members 2 and 3 close the coin slot 122 and openings 102 and 112, respectively, so that a coin C set in the coin slot 122 is blocked from falling. The plate members 2 and 3 are generally flush at the tops thereof with that of the base member 1 so that the base member 1 and plate members 2 and 3 appear as if they were a single plate.

When in the opened position (shown in FIGS. 2, 8, 10 and 12), the plate members 2 and 3 fall due to their own weight and the coin C having been held in the coin slot 122 by the plate member 2 will fall down through the slot 122 onto the top of the plate member 3.

Figure 9:
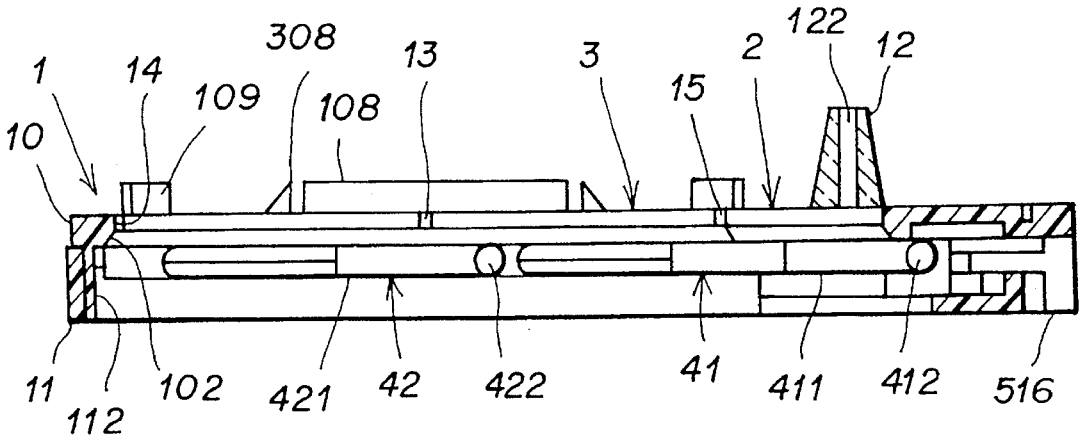
FIG. 9 is a sectional view taken along the line IX—IX in FIG. 1.
Figure 10:
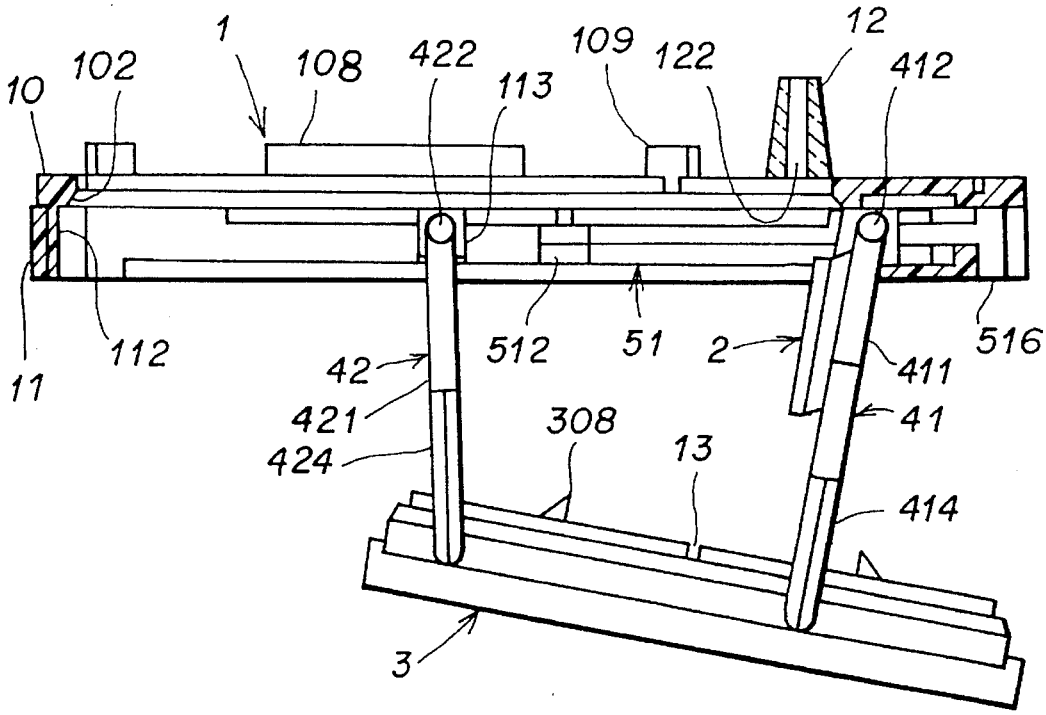
FIG. 10 is a sectional view taken along the line X—X in FIG. 2.

The plate members 2 and 3 are made of an opaque synthetic resin, for example. The one 2 of these plate members will be called a "first plate member" hereafter and it serves to close the coin slot 122 and a part of the opening 102 while the other plate member 3 will be called a "second plate member" hereafter and it serves to close the remainder of the opening 102, as shown in FIGS. 1 and 9.

The second plate member 3 consists of a thin hollow case having a generally rectangular shape when viewed from above. This second plate member 3 consists of an upper portion 30 and a lower portion 31 as shown in FIGS. 5 and 6.

Figure 5:
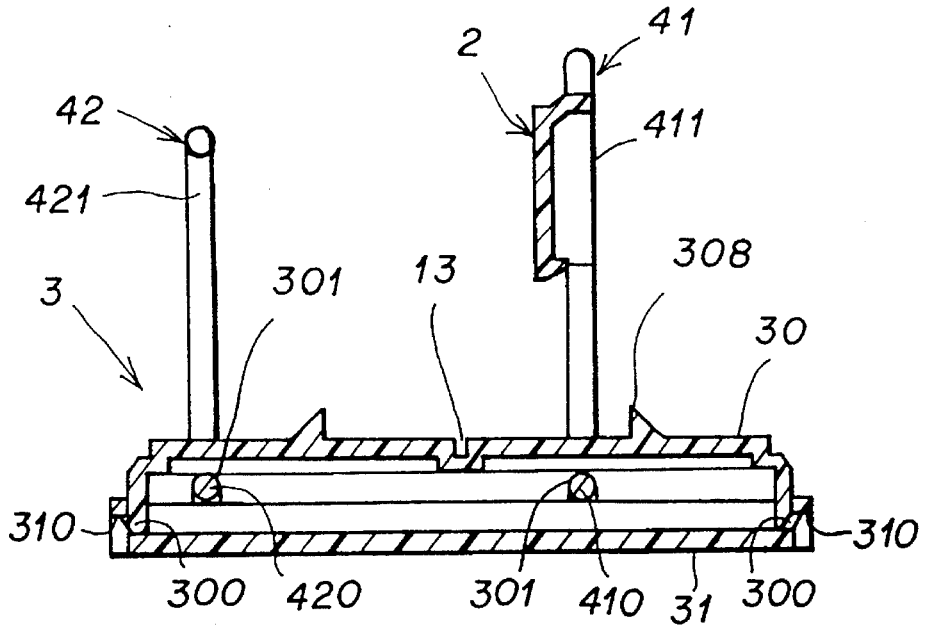
FIG. 5 is a sectional view taken along the line V—V in FIG. 4.
Figure 6:
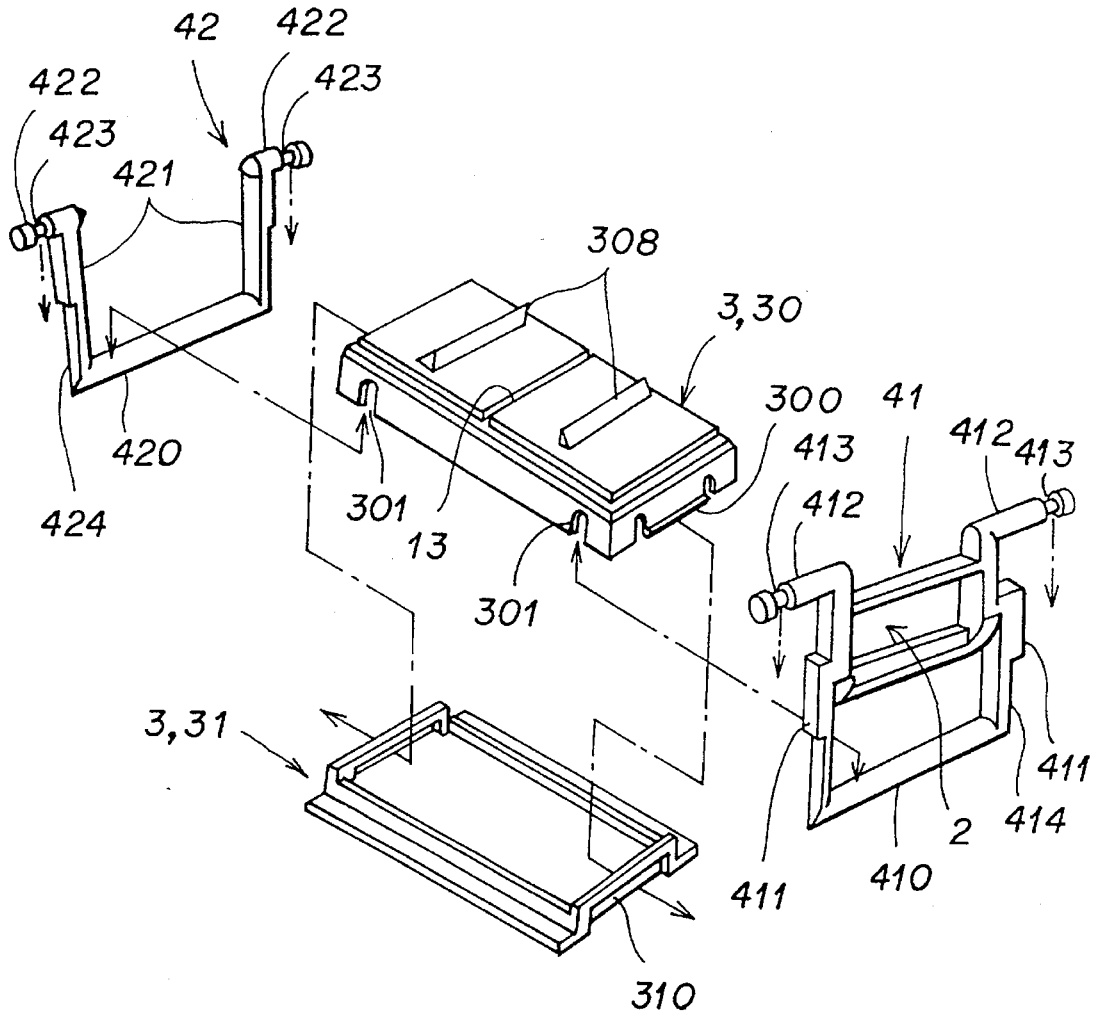
FIG. 6 is an exploded perspective view of the plate members and support members.

As shown in FIGS. 5 and 6, the upper portion 30 has recesses 300 formed in the opposite end walls, respectively, thereof and the lower portion 31 has elastic pawls 310 formed on the opposite end walls, respectively, thereof in positions corresponding to those of the recesses 300. By engaging the pawls 310 of the lower portion 31 elastically into the corresponding recesses 300, respectively, of the upper portion 30, the upper and lower portions 30 and 31 are assembled together to form the thin hollow case.

As shown in FIGS. 1 and 2, there are formed recesses 13 in the top surfaces, respectively, of the upper portion 30 of the second plate member 3 and the upper portion 10 of the base member 1. These recesses 13 are provided to ensure that a boundary 14 between the base member 1 and the first and second plate members 2 and 3 and a boundary 15 between the first and second plate members 2 and 3 are not noticeable when the openings 102 and 112 of the base member 1 are closed with the first and second plate members 2 and 3. The recesses 13 and boundaries 14 and 15 are disposed longitudinally and laterally to define 9 squares as shown.

Figure 4:
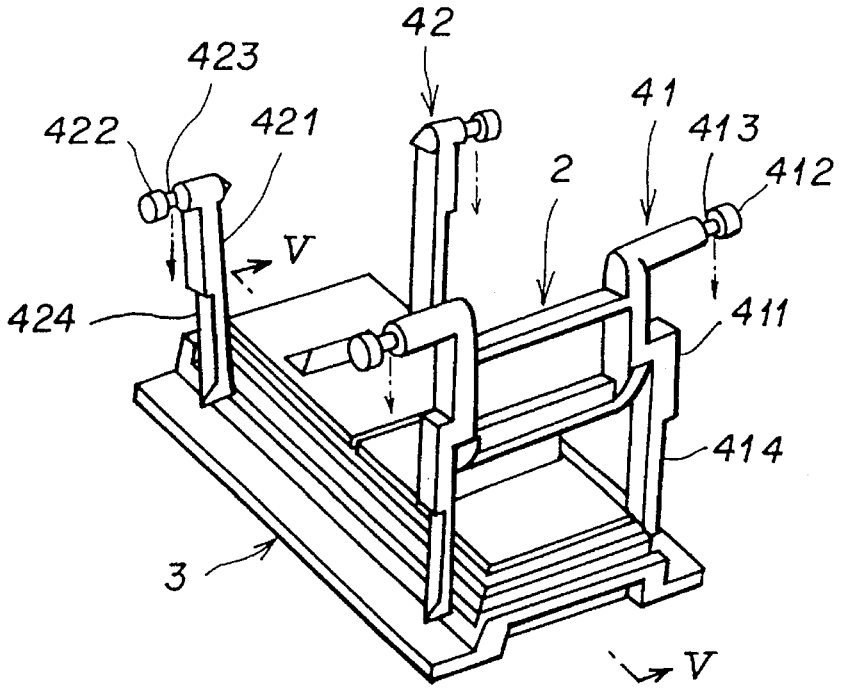
FIG. 4 is a perspective view of the plate members and support members.

The previously-mentioned first and second support members 41 and 42 are made of, for example, a synthetic resin. As shown in FIGS. 4 to 6, the first support member 41 consists of a central shaft portion 410, a pair of arm portions 411 formed integrally with the central shaft portion 410 and extending in a direction nearly perpendicular to the central shaft portion 410 from opposite ends thereof, and a pair of end shaft portions 412 formed integrally with the pair of arm portions 411 and extending in a direction nearly perpendicular to the pair of arm portions 411 outwardly from the opposite ends of the latter. On the other hand, the second support member 42 consists of a central shaft portion 420, a pair of arm portions 421 formed integrally with the central shaft portion 420 and extending in a direction nearly perpendicular to the central shaft portion 420 from opposite ends thereof, and a pair of end shaft portions 422 formed integrally with the pair of arm portions 421 and extending in a direction nearly perpendicular to the pair of arm portions 421 outwardly from the opposite ends of the latter.

The first support member 41 and first plate member 2 are formed integrally with each other. That is to say, the first plate member 2 is formed on the pair of arm portions 411 of the first support member 41 in a location nearer to the pair of end shaft portions 412.

The central shaft portion 410 of the first support member 41 and that 420 of the second support member 42 are rotatably fitted in four cuts 301 formed in the two opposite lateral walls of the upper portion 30 of the second plate member 3. Each of the cuts 301 is circular at the upper portion thereof.

As indicated with an arrow A in FIG. 3 and also in FIGS. 7 and 8, the end shaft portions 412 of the first support member 41 and those 422 of the second support member 42 are rotatably fitted in four beatings 113 formed on the lower portion 11 of the base member 1. Thus, the first and second plate members 2 and 3 are coupled to the base member 1 so as to be movable between the closed and opened positions. The base member 1, first plate member 1 and first support member 41, second plate member 3 and the second support member 42 define together a parallelogram.

The above-mentioned bearings 113 have formed therein cuts 114 circular in shape at the lower portions thereof. The end shaft portions 412 and 422 have formed therein annular grooves 413 and 423, respectively, which are to be fitted into the cuts 114, respectively.

The end shaft portions 412 of the first support member 41 and those 422 of the second support member 42 (only the end shaft portions 422 being shown for the simplicity of illustration) are held by retainers 107, respectively, formed integrally on the bottoms of the upper portions 10 of the base member 1.

Different from the first support member 41, nothing like the first plate member 2 or the like is provided between the arm portions 421 in pair of the second support member 42, so that the end shaft portions 422 of the pair of arm portions 421 are likely to deflect. To prevent the end shaft portions 422 of the second support member 41 from dropping out of the beatings 113 on the base member 1, the upper portion 10 of the base member i has formed integrally thereon stoppers 103 which the end shaft portions 422 of the second support member 42 abut at the inner sides thereof, as shown in FIG. 8.

Figure 11:
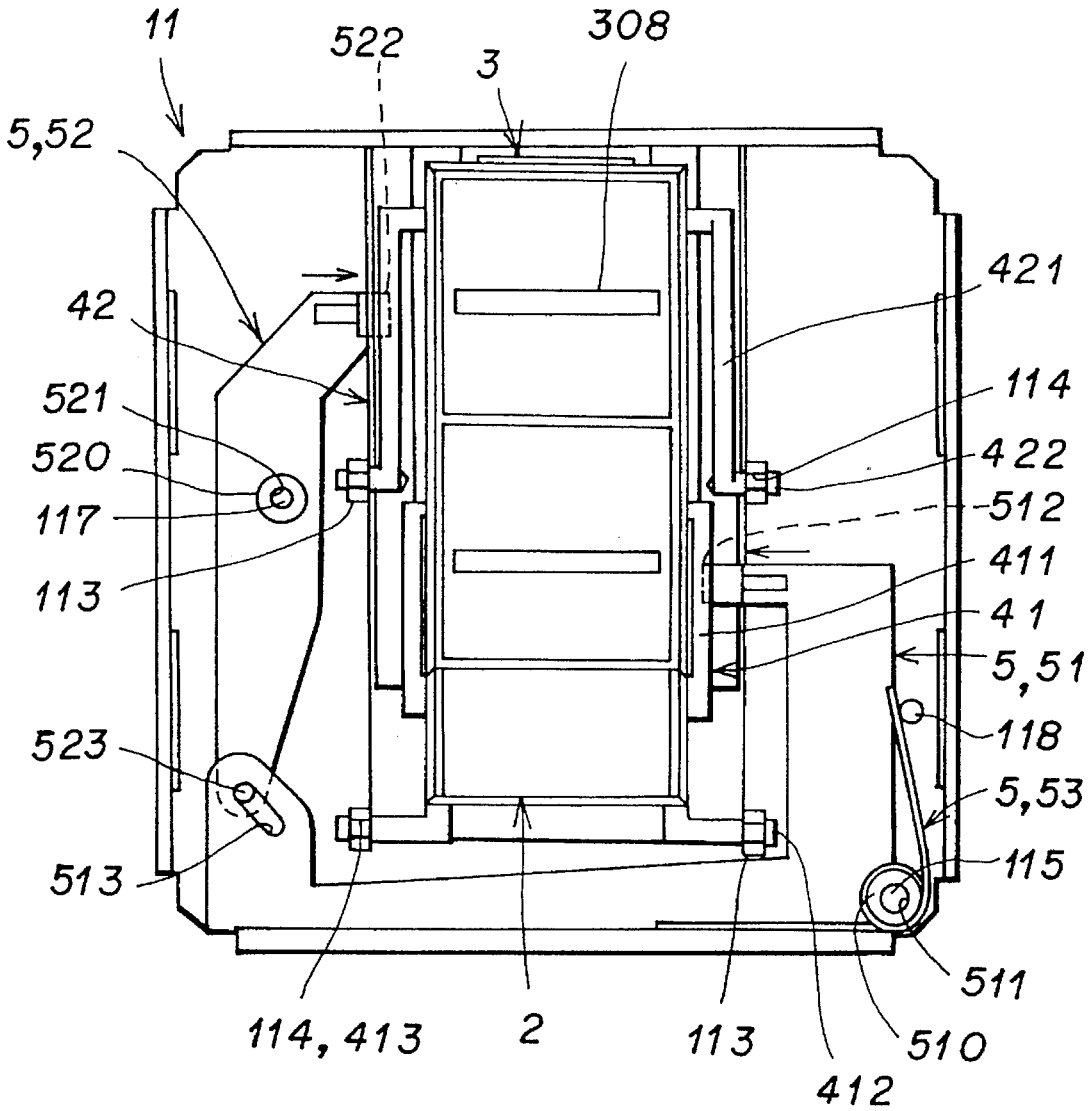
FIG. 11 is a plan view of the apparatus with the plate members in the closed position and the upper portion of the base member omitted.
Figure 12:
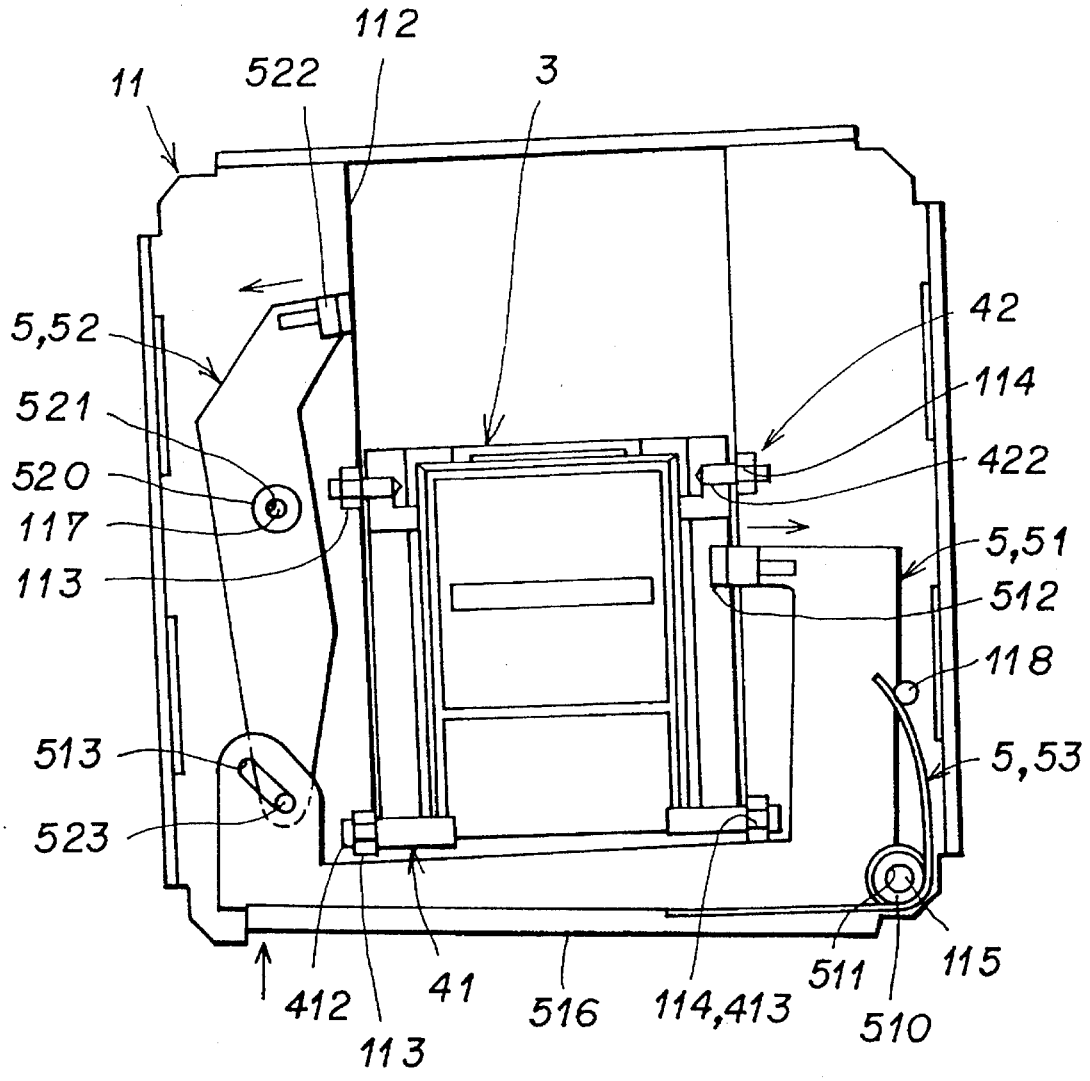
FIG. 12 is a plan view of the apparatus with the plate members in the opened position and the upper portion of the base member omitted.

A locking mechanism 5 is shown in FIGS. 3, 11 and 12. The locking mechanism 5 is provided to lock and free the plate members 2 and 3 in the closed position. The locking mechanism 5 is made of, for example, a synthetic resin. The locking mechanism 5 consists of a first locking member 51, second locking member 52 and a torsion spring 53.

The first locking member 51 is generally shaped like "L" character. This first locking mechanism 51 has formed integrally at the central corner thereof a boss 510 in which a small circular through-hole 511 is formed. The lower portion 11 of the base member i has formed at one corner on the upper side thereof a first shaft 115 which is fitted in the through-hole 511 in the first locking member 51, to thereby support the first locking member 51 pivotably inside the base member 1. The first locking member 51 has formed integrally on the lateral side thereof an operating plate 516 which are disposed in cuts 106 and 116 formed in the front walls, respectively, of the upper and lower portions 10 and 11 of the case or base member 1.

The second locking member 52 has the form of a plate. It has formed integrally at the middle thereof a boss 520 in which a small circular through-hole 521 is formed. The lower portion 11 of the base member 1 has formed at one corner on the upper side thereof a second shaft 117 which is fitted in the through-hole 521 in the second locking member 52, to thereby support the second locking member 52 pivotably inside the base member 1.

The first and second locking members 51 and 52 are provided at the first ends thereof locking pawls 512 and 522, respectively, which are disposed at the lateral edges of the openings 102 and 112, respectively, of the base member 1.

The first locking member 51 has an elongated hole 513 formed in the second end thereof, while the second locking member 52 has a shaft 523 formed on the second end thereof. The shaft 523 is fitted into the elongated hole 513.

The above-mentioned torsion spring 53 is coiled nearly at the middle thereof. The coiled portion is fitted on the boss 511 of the first locking member 510, and the end portions of the torsion spring 53 are deflected in the direction of arrow in FIG. 3 and resiliently engaged on a third shaft 118 provided on the upper side of the upper portion 11 of the base member 1 and the operating plate 516 of the first locking member 51, respectively.

The resilience of the torsion spring 53 acts on the first locking member 51 and on the second locking member 52 via the first locking member 51. As shown in FIG. 11, the locking pawl 512 of the first locking member 51 engages on a chamfered portion 414 of the arm portion 411 of the first support member 41 while the locking pawl 522 of the second locking member 52 engages on a chamfered portion 424 of the arm portion 421 of the second support member 42. Thus, the plate members 2 and 3 are locked in the closed position.

When the operating plate 516 of the first locking member 51 is pressed against the resilience of the torsion spring 53 in the direction of arrow in FIG. 12, the locking pawl 512 of the first locking member 51 is pivoted clockwise as shown with the arrow in FIG. 12 and disengaged from the chamfered portion 414 of the first support member 41 while the locking pawl 522 of the second locking member 52 is pivoted counterclockwise and disengaged from the chamfered portion 424 of the second support member 42. The plate members 2 and 3 are thus unlocked or freed from the locking by the first and second locking members 51 and 52.

Figure 13:
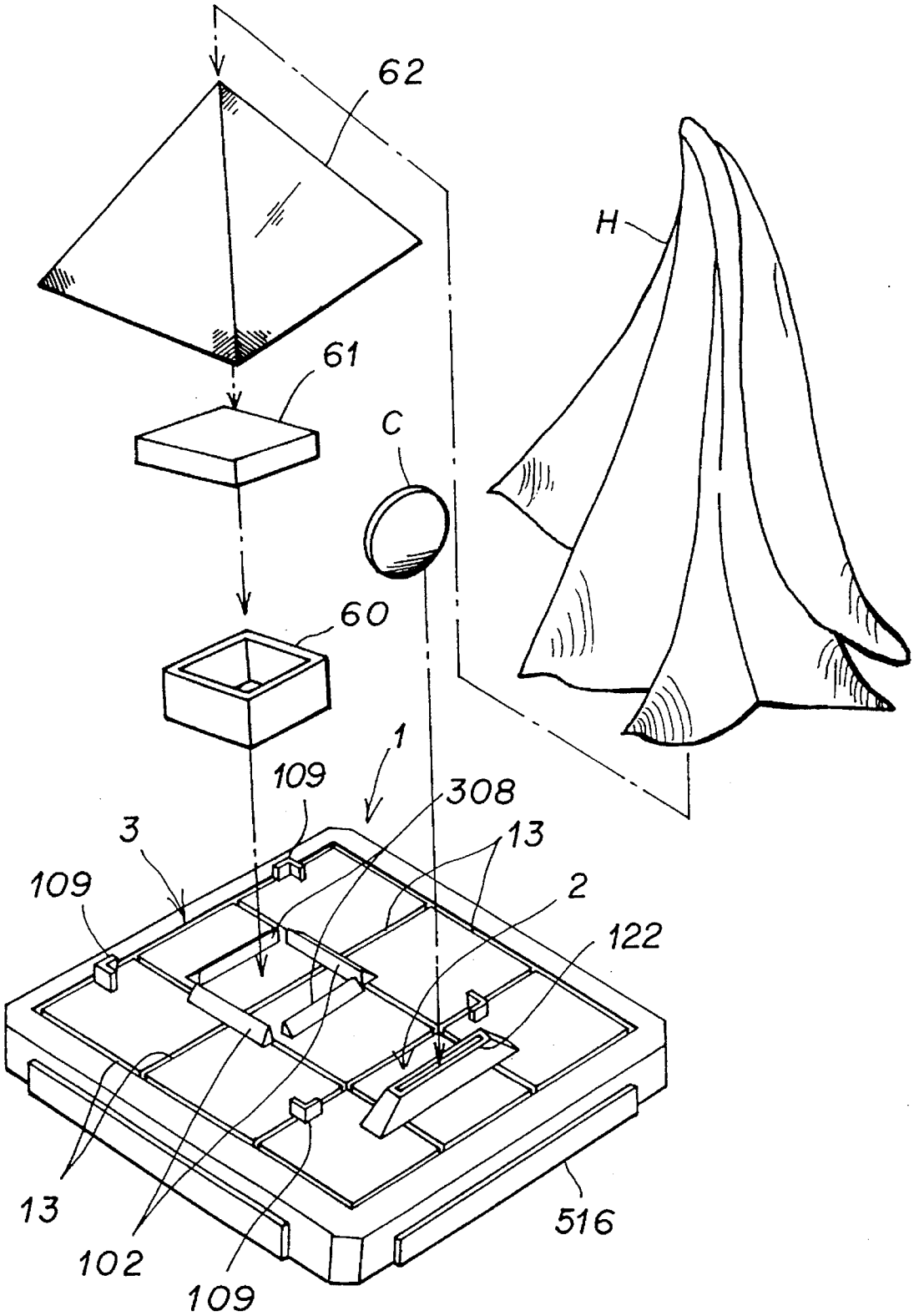
FIG. 13 is a perspective view of the apparatus, accessories, handkerchief and a coin.

As in FIG. 13, the apparatus according to the present invention is provided with an accessory coin receiver 60. The coin receiver 60 is a hollow case made of, for example, an opaque synthetic resin, having the shape of a rectangular parallelepiped and open at the top thereof. Two projections 108 are formed on the top of the upper portion 10 of the base member 1, and two other projections 308 are formed on the top of the second plate member 3, these four projections 108 and 308 defining together a square. The coin receiver 60 is removably set inside these projections 108 and 308.

FIG. 13 shows also an accessory lid 61. This lid 61 is hollow and open at the bottom thereof, having the shape of a rectangular parallelepiped. It is made of, for example, an opaque synthetic resin. The lid 61 is removably set on the edges of the top opening of the coin receiver 60 or outside the projections 108 which are the two opposite sides of the square.

Also FIG. 13 shows an accessory cover 62. The cover 62 is a hollow pyramid open at the bottom thereof, and made of, for example, a transparent synthetic resin. As shown, the base member 1 has formed on the top of the upper portion 10 thereof pawls 109 each forming a corner of a square. The cover 62 is removably set inside the pawls 109.

The coin transfer apparatus for jugglery use according to the present invention is constructed as having been described in the foregoing. The apparatus are to be used as explained in the following:

First, the user prepares and shows to the audience the apparatus according to the present invention, a handkerchief H (not any see-through one, if possible) and a coin C as shown in FIG. 13. The user closes the plate members 2 and 3 of the apparatus and locks them in the closed position by the locking mechanism 5. Then, the user puts the apparatus onto the top of a table T or the like.

Next, the user sets the accessory coin receiver 60 inside the projections 108 on the base member 1 and those 308 on the second plate member 3, these four projections 108 and 308 defining together a square. Then, the user sets the accessory lid 61 on the edges of the top opening of the coin receiver 60. Further, the user sets the pyramid-like cover 62 inside the pawls 109 on the base member 1, each of the pawls 109 forming a corner of a square. The cover 62 will thus encase the coin receiver 60 and lid 61 in it.

Figure 14:
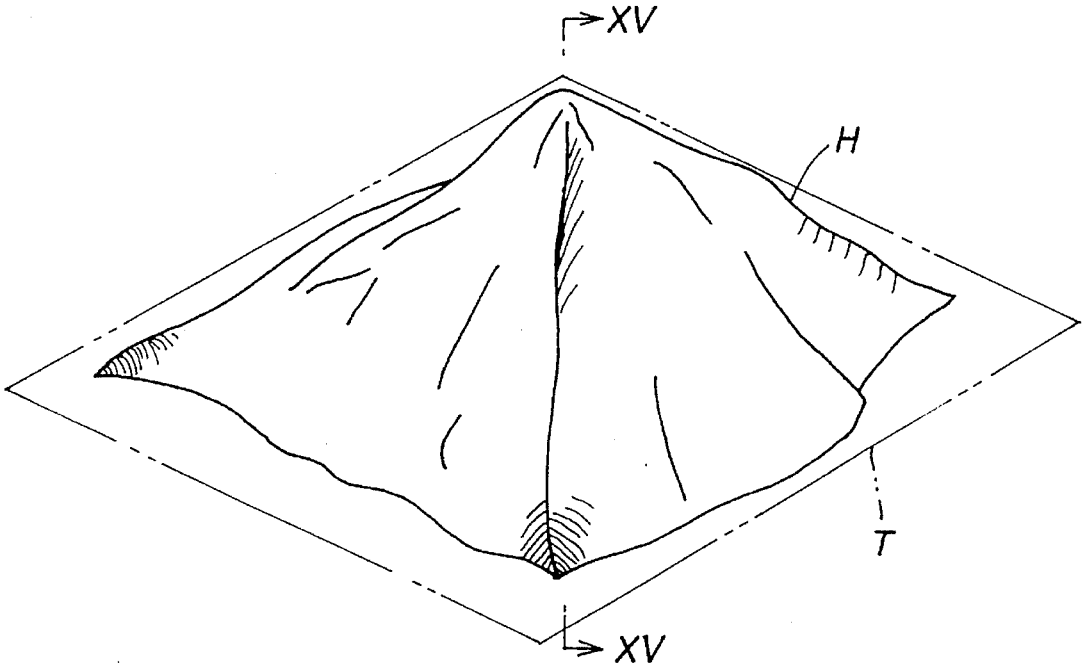
FIG. 14 is a perspective view of the apparatus used in a jugglery of coin transfer, showing a handkerchief put over the apparatus with the plate members in the closed position and a coin set in the coin slot.
Figure 15:
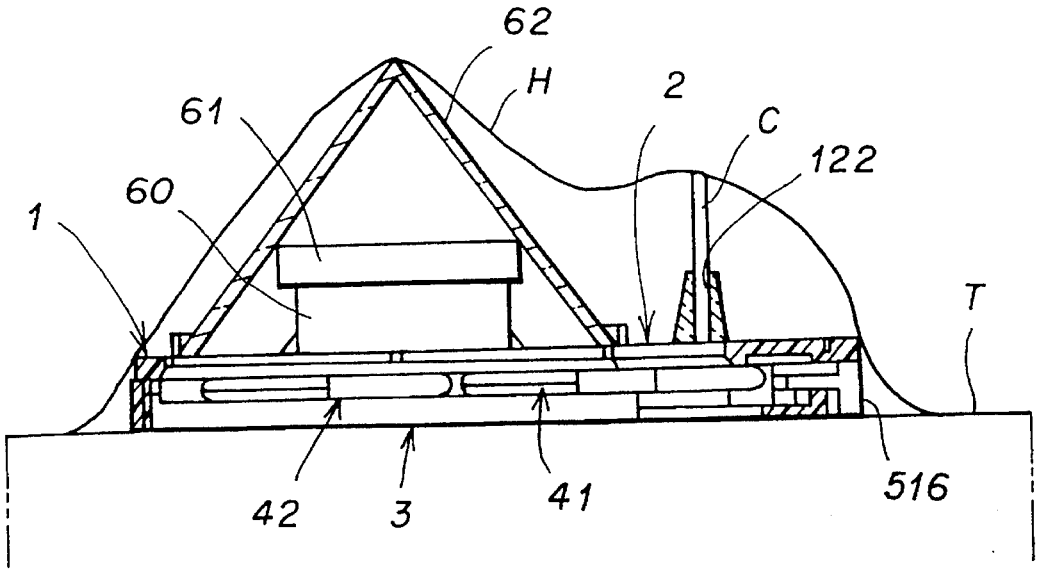
FIG. 15 is a sectional view taken along the line XV—XV in FIG. 14.
Figure 16:
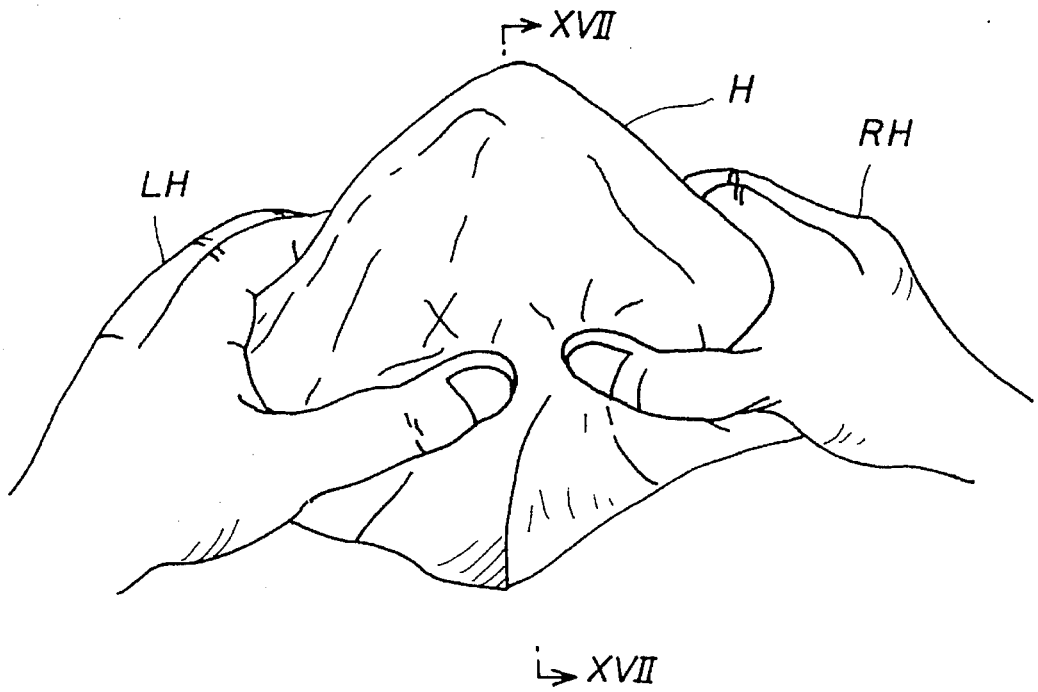
FIG. 16 is a perspective view of the apparatus used in a jugglery of coin transfer, showing a handkerchief put over the apparatus with the plate members in the opened position and a coin fallen into the coin receiver from the coin slot.
Figure 17:
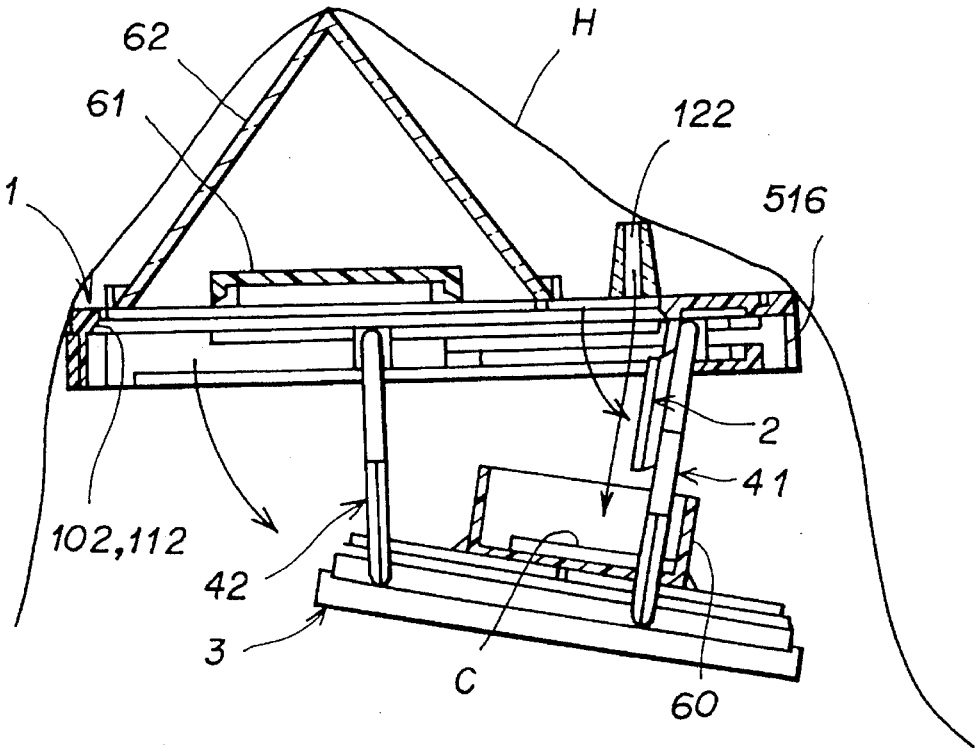
FIG. 17 is a sectional view taken along the line XVII—XVII in FIG. 16.

Then, the user sets the coin C in the coin slot 122. Since the bottom opening of the coin slot 122 is closed by the first plate member 2 at this time as shown in FIG. 15, the coin C will be blocked from falling through the coin slot 122. Then, the user puts the handkerchief H over the apparatus and coin C as shown in FIG. 14.

Thereafter, the user presses the operating plate 516 from above the handkerchief H against the resilience of the torsion spring 53. The pawl 512 of the first locking member 51 will be disengaged from the chamfered portion 414 of the first support member 41, while the pawl 522 of the second locking member 52 will be disengaged from the chamfered portion 424 of the second support member 42, thus the plate members 2 and 3 locked by the locking mechanism 5 are freed.

When the locking by the locking mechanism 5 is thus released, the first plate member 2 pivots and is opened from the closed position in the direction of arrow about the send shaft portions 412 of the first support member 41 and the second plate member 3 is freed from the closed position and moved generally in parallel with the base member 1 in the direction of arrow, both under the action of the above-mentioned parallelogram (defined by the base member 1, first plate member 2 and first support member 41, second plate member 3 and second support member 42). At this time, the coin receiver 60 placed on the second plate member 3 will be moved along with the second plate member 3, but the accessory lid 61 set on the coin receiver 60 will keep retained on the projections 108 of the base member 1 and so will stay on the base member 1. On the other hand, the coin C will fall into (or be received in) the coin receiver 60 as guided on the first plate member 2 from the coin slot 122 thus opened (because the first plate member 2 has left the bottom of the coin slot 122).

After the coin C is received in the coin receiver 60, the user closes the opened plate members 2 and 3. More particularly, the user puts the opened second plate member 3 into contact with the top of the table T or the like. When the base member 1 is put onto the top of the table T, the first plate member 2 will be pivoted in an opposite direction to the direction of arrow in FIG. 17 while the second plate member 3 is moved nearly in parallel with the base member 1 in an opposite direction of the direction of arrow also in FIG. 17, until the coin slot 122 and openings 102 and 112 of the base member 1 are closed with the plate members 2 and 3, respectively. Then, the lid 61 will be set on the coin receiver 60 in which the coin C has been received, and thus the lid 61, coin receiver 60 and plate members 2 and 3 will return to the initial positions they took before covered with the handkerchief H.

When the operating plate 5 16 is stopped from being pressed, the resilience of the torsion spring 53 will cause the pawl 512 of the first locking member 51 to pivot counter-clockwise in the direction of arrow in FIG. 11 and engage on the chamfered portion 414 of the first support member 41 while the pawl 522 of the second locking member 52 will be caused by the resilience of the torsion spring 53 to pivot clockwise and engage on the chamfered portion 424 of the second support member 42. Thus, the plate members 2 and 3 will be locked in the closed position by the locking mechanism 5 as shown in FIG. 15.

Thereafter, the user takes off the handkerchief H from on the apparatus. There the audience will miss the coin C they saw set in the coin slot 122. The user takes the cover 62 from on the base member 1 and then the lid 61 from on the coin receiver 60. Further, the user takes the coin receiver 60 from on the second plate member 3 and shows the inside of the coin receiver 60 to the audience. The audience will find there the coin C they have once missed in the coin slot 122. Namely, the audience will be given an illusion that the coin C has been transferred from the coin slot 122 into the coin receiver 60 on the second plate member 3. The apparatus according to the present invention can thus be used simply to provide an illusion of coin transfer. Also the plate members 2 and 3 can be positively closed and freed owing to the locking mechanism 5.

The plate members 2 and 3 can be closed only by both hands, without using the table T or the like. That is to say, the base member 1 is held in one hand while the second plate member 3 is held in other hand. In this condition, the plate members 2 and 3 can be closed by pivoting and moving in parallel with the base member 1, respectively.

The coin transfer apparatus according to the above-mentioned preferred embodiment of the present invention is provided with the locking mechanism 5, but the locking mechanism 6 may not always be provided in the apparatus according to the present invention.

As having been described in the forgoing, the preferred embodiment of the present invention uses the coin receiver 60, lid 61 and cover 62. However, they may not always be required for the coin transfer apparatus for jugglery use according to the present invention.

Besides, although the plate members include the first and second ones 2 and 3 in the aforementioned preferred embodiment, a one-piece plate member may be adopted for the same purpose.

What is claimed is:

1. A coin transfer apparatus for jugglery use, comprising:

a base member having a coin slot and openings formed therein;

plate members disposed movably in relation to said base member to close and open said coin slot and openings;

support members supporting said plate members movably between closed and opened positions;

one of said plate members, when placed in said closed position, closing said coin slot and openings to block a coin set in said coin slot from falling and being generally flush at the top thereof with that of said base member so that said base member and said one of said plate members appear like a single plate; and said plate members, when in said opened position, falling due to their own weight and said coin, having been held in said coin slot by said one of the plate members, falling down through said coin slot onto the top of a second of said plate members.

2. A coin transfer apparatus as set forth in claim 1, further comprising:

a locking mechanism which locks said plate members in said closed position and frees them from their locked status.

3. A coin transfer apparatus as set forth in claim 2, further comprising:

a coin receiver made of an opaque material, hollow and open at the top thereof, disposed on the top of the second of said plate members and movable along with said second plate member;

a lid made of an opaque material, hollow and open at the bottom thereof, and disposed on the edges of the top opening of said coin receiver to close the top opening of said coin receiver when said plate members are set in said closed position while being disposed on the edges of a one of the openings in said base member which is closed and opened by said second plate member to open the top opening of said coin receiver; and a cover made of a transparent material, hollow and open at the bottom thereof, and removably disposed on the top of said base member to cover said coin receiver and lid.

4. A coin transfer apparatus as set forth in claim 3, wherein said cover has the outer general shape of a pyramid.

5. A coin transfer apparatus as set forth in claim 1, further comprising:

a coin receiver made of an opaque material, hollow and open at the top thereof, disposed on the top of the second of said plate members and movable along with said second plate member;

a lid made of an opaque material, hollow and open at the bottom thereof, and disposed on the edges of the top opening of said coin receiver to close the top opening of said coin receiver when said plate members are set in said closed position while being disposed on the edges of a one of the top openings in said base member which is closed and opened by said second plate member to open the top opening of said coin receiver; and a cover made of a transparent material, hollow and open at the bottom thereof, and removably disposed on the top of said base member to cover said coin receiver and lid.

6. A coin transfer apparatus as set forth in claim 5, wherein said cover has the outer general shape of a pyramid.

7. A coin transfer apparatus as set forth in claim 1, wherein said plate members include a first plate member which closes and opens said coin slot and a part of said opening, and a second plate member which closes and opens the remainder of said opening.

8. A coin transfer apparatus as set forth in claim 7, wherein said first plate member is integral with said support members.

* * * * *